US005842874A

United States Patent [19]

Yagi et al.

[11] Patent Number: 5,842,874

[45] Date of Patent: Dec. 1, 1998

[54] DUAL HOUSING BOARD-TO-BOARD CONNECTOR

[75] Inventors: Masanori Yagi, Ebina; Yoshikazu Ito, Yamato; Hiroshi Ikesugi, Yokohama, all of Japan

[73] Assignee: Molex Incorporated, Lisle, Ill.

[21] Appl. No.: 737,666

[22] PCT Filed: Jan. 19, 1995

[86] PCT No.: PCT/US95/00641

§ 371 Date: Nov. 20, 1996

§ 102(e) Date: Nov. 20, 1996

[87] PCT Pub. No.: WO95/32530

PCT Pub. Date: Nov. 30, 1995

[30] Foreign Application Priority Data

| | | | |
|---|---|---|---|
| May 25, 1994 | [JP] | Japan | 6-135153 |
| Jul. 19, 1994 | [JP] | Japan | 6-21554 |
| Jul. 19, 1994 | [JP] | Japan | 6-21555 |

[51] Int. Cl.[6] ..... H01R 9/09

[52] U.S. Cl. ..... 439/74; 439/540.1

[58] Field of Search ..... 439/74, 540.1, 439/637, 660

[56] References Cited

U.S. PATENT DOCUMENTS

| | | | |
|---|---|---|---|
| 4,134,632 | 1/1979 | Lindberg et al. . | |
| 4,971,565 | 11/1990 | Fox | 439/74 |
| 4,993,965 | 2/1991 | Eck | 439/374 |
| 5,013,263 | 5/1991 | Gordon et al. | 439/630 |
| 5,076,804 | 12/1991 | Bertho et al. | 439/567 |
| 5,306,163 | 4/1994 | Asakawa | 439/74 |
| 5,558,540 | 9/1996 | Kato | 439/637 |

FOREIGN PATENT DOCUMENTS

| | | |
|---|---|---|
| 5135835 | 6/1993 | Japan . |
| 547443 | 2/1995 | Japan . |
| 7201401 | 8/1995 | Japan . |
| 80212116 | 6/1992 | Taiwan . |
| 84206174 | 1/1996 | Taiwan . |
| WO9215187 | 9/1992 | WIPO . |

OTHER PUBLICATIONS

COmponent Product Information "0.5mm staking PCB Connector WR Series (2 rows)", Japan Aviation Electronics Ind. Ltd. (Sep. 1994) (2 pages).

*Primary Examiner*—Gary F. Paumen
*Attorney, Agent, or Firm*—Charles S. Cohen

[57] ABSTRACT

A surface mount, board-to-board connector includes two interengaging plug connector and receptacle connector halves (18,16). Each of the plug and receptacle connector halves includes respective dual plug and receptacle housings (60,20) spaced apart from each other in a substantially parallel relationship. The dual connector housings of the plug and receptacle connector halves are evenly spaced apart by bridging pieces (50,80) which extend between the connector housings to connect them together. The bridging pieces may be integrally formed with the connector housings or they may be separately formed from the connector housings and include engagement members which engage the connector housing.

25 Claims, 6 Drawing Sheets

DUAL HOUSING BOARD-TO-BOARD CONNECTOR

BACKGROUND OF THE INVENTION

The present invention relates generally to electrical connectors and, more particularly, to an improved surface mount, board-to-board connector having an increased number of electrical terminals and a structure which decreases the likelihood of encountering misalignment of the connector terminals during installation to a circuit board.

Board-to-board connectors for electrically connecting a pair of parallel circuit board or members are well known in the art. These board-to-board connectors typically utilize two opposing connector components mounted to respective opposing surfaces of the circuit boards and which project away from the circuit board mounting surfaces. One of the connector components is a male member and includes a plug member, while the other of the two connector components is a female member and includes a receptacle. The male plug member fits into the female receptacle in order to connect the two circuit boards together.

Board-to-board connectors further include a series of electrical terminals disposed in the two interengaging male and female connector members which contact each other when the male member is fitted into the female member. These terminals have solder tail portions which extend out from the connector member bottom portions and either extend through holes in a circuit board or engage a like number of electrical contact pads, or traces, formed on the surfaces of the respective circuit boards and are subsequently soldered thereto. This latter mounting method is referred to in the art as surface mounting.

Surface mount connectors present certain problems which may compromise the reliability of the connection between the connector terminal tails and the circuit board contact pads. The contact terminals of surface mount board-to-board connectors extend along the length of the connectors and thus, the number of circuits that a surface mount connector can accommodate is limited by the length of the connector. A surface mount connector that accommodates a small number of circuits, such as 20 circuits, is much shorter than a connector that must accommodate a large number of circuits, such as 200 circuits or more.

In surface mounting of board-to-board electrical connectors onto circuit boards, it is desirable to have all of the connector terminal tails lie in a common plane which is adjacent to the mounting surface of the circuit boards so that the terminal tails will contact the circuit board traces. However, it is often difficult to achieve this objective because circuit boards may be formed according to low tolerances that may lead to warping or other distortion in circuit boards which may occur during the manufacture of the circuit boards, during assembly of components onto the circuit boards or during assembly of secondary circuit boards to a mother board.

For example, heat generated by soldering components, or terminals of a connector, to a circuit board may create thermal stresses within the circuit board which induce warpage or distortion into the circuit board. Additionally, when secondary circuit boards are mechanically mounted to a mother board, such as by standoffs, they may be mounted either unevenly or the securement screws overtightened such that internal stresses may develop within the circuit boards which also may induce warpage or distortion into the circuit board.

This area of distortion typically manifests itself as a depressed or raised area of the circuit board that is no longer co-planar with the mounting surface of the circuit board. This warpage or distortion may prevent some of the connector terminals from lying adjacent to and in contact with the circuit board contact pads. Rather, some of the connector terminal tails may be spaced apart from the opposing circuit board contact pads by a gap equal to the displacement of the warped area from the board mounting surface. With such a gap, the possibility exists that the terminals may not contact the solder paste or at least not become reliably attached to the circuit board during the soldering. If the solder tail is not soldered to its corresponding contact pad, the entire board will be defective. If a poor solder joint is formed, such soldered joint will be weaker than the rest of the soldered joints that occurs between the connector and circuit board in the area that is not warped and may eventually fail.

The problems described above may be avoided by utilizing surface mount connectors of relatively short length so that the connector and its associated terminal tails will lie flat on the circuit boards within the area of warpage as opposed to extending across the area of warpage. However, this solution limits the design of the electronic component to the use of a single, short length connector. In applications where the circuit boards have a large number of circuits which must be connected between two parallel circuit boards, a longer length connector must be used to accommodate this larger number of circuits.

Where the surface mount connector has a length which is greater than the warped area, a portion of the connector and its associated terminal tails may extend over the warped area and out of contact with the contact pads thereof. As the length of surface mount connectors increases, the likelihood of encountering a warped area on a circuit board also increases. The likelihood of moving the terminals out of parallelism also occurs. Thus it may be understood that as mentioned above, when a surface mount connector encounters a warped area, one or more terminal tails will be out of the contact plane with the board and the possibility that defective solder joints will occur increases.

An alternate attempt at achieving a greater number of contacts between two parallel printed circuit boards has been to utilize two pairs of board to board connectors rather than one pair of longer connectors. In some applications, this has proven generally ineffective as the pitch of the connectors has become smaller because the manufacturing tolerances resulting from molding of the housings, stamping of the terminals, positioning of the terminals within the housing and placement of the connectors on the printed circuit boards tend to add or "stack" up. The smaller pitch of these connectors increases the need to maintain exact alignment of all of the connectors which is an expensive and sometimes impossible goal. In particular, when mounting two plug connectors on a first circuit board and two receptacle connectors on a second board, the connectors on each board must be almost perfectly aligned. Misalignment or rotation of one connector relative to the other of only 1 degree may result in an offset of approximately 0.861 mm for the connector which will effectively prevent mating of the connectors on the first and second boards and possibly result in some of the connector terminal tails not contacting their corresponding circuit board contact tails.

The present invention overcomes these disadvantages and provides benefits over the prior art by providing two connectors arranged in a generally parallel fashion and joined together by bridging pieces which maintain the two connectors in a generally parallel and side-by-side relationship.

Accordingly, it is a general object of the present invention to provide a new and improved surface mount, board-to-board connector.

Another object of the present invention to provide a new and improved surface mount, board-to-board electrical connector assembly for connecting two parallel circuit boards together, which connector assembly includes two connector housings interconnected by spacer members.

Still another object of the present invention is to provide a dual housing board-to-board, surface mount connector assembly having a male connector component and a female connector component, the male connector component having two elongated connector housing bodies interconnected at their opposing ends of the connector bodies to maintain the connector housing bodies in a parallel relationship and to maintain the electrical contact terminals disposed within the connector housing bodies in alignment with the circuit board contact pads.

A still further object of the present invention is to provide a board-to-board, surface mount connector assembly having male and female dual interengaging connector housings of relatively short length, wherein the male and female dual connector housings are joined together by bridging pieces at their opposing ends in order to maintain the connector housings in a parallel spacing, thereby improving the interengagement of the male dual connector housings with the female dual connector housings and thereby reducing the likelihood of misalignment of the connector housing during attachment to a printed circuit board.

SUMMARY OF THE INVENTION

The present invention is directed to a surface mount board-to-board connector which overcomes the above-mentioned disadvantages and which offers an improvement over prior art surface mount, board-to-board connectors by reducing the overall length of surface mount board-to-board connectors while accommodating a larger number of circuits relative to the length of the connector and reducing the likelihood of encountering a warped or distorted mounting area.

In one principal aspect of the present invention and in accordance with a first embodiment of the invention, an improved surface mount, board-to-board connector assembly includes a dual plug housing assembly and a dual receptacle housing assembly. The plug housing assembly has two male connector housings disposed generally parallel to each other and joined together at the opposing ends of the housings by spacer members, or bridging pieces integrally formed with the male connector housings. The receptacle housing assembly has two female connector housings disposed in a spaced-apart, parallel relationship and joined together at opposing ends by integral spacer members which maintain the alignment of both the plug and receptacle housings for mounting purposes and also maintain the alignment of the contact terminal tails.

In another principal aspect of the present invention and in accordance with a second embodiment, the improved board-to-board connector assembly includes a pair of opposing male and female dual connector assemblies, each of the male and female connector assemblies having two elongated housing portions arranged in a spaced-apart, parallel fashion, with each housing portion having a plurality of electrical terminals disposed therein on opposing surfaces thereof. The electrical terminals of the male and female connector assemblies engage each other when the connector assemblies are interengaged with each housing portions having engagement members disposed on opposing ends received within recesses formed in separate spacer members having engagement means that engage opposing ends of the housings. The spacer members interconnect the housings of the male and female connector assemblies together and maintain them in spaced-apart, parallel fashion, whereby, electrical terminal tails extending from the housing are aligned with each other and with opposing electrical contact traces upon mounting surfaces of opposing printed circuit boards.

These and other objects, features and advantages of the present invention will be clearly understood through a consideration of the following detailed description.

BRIEF DESCRIPTION OF THE DRAWINGS

In the course of the following detailed description reference will be made to the attached drawing wherein like reference numerals identify like parts and wherein.

Figure 1:
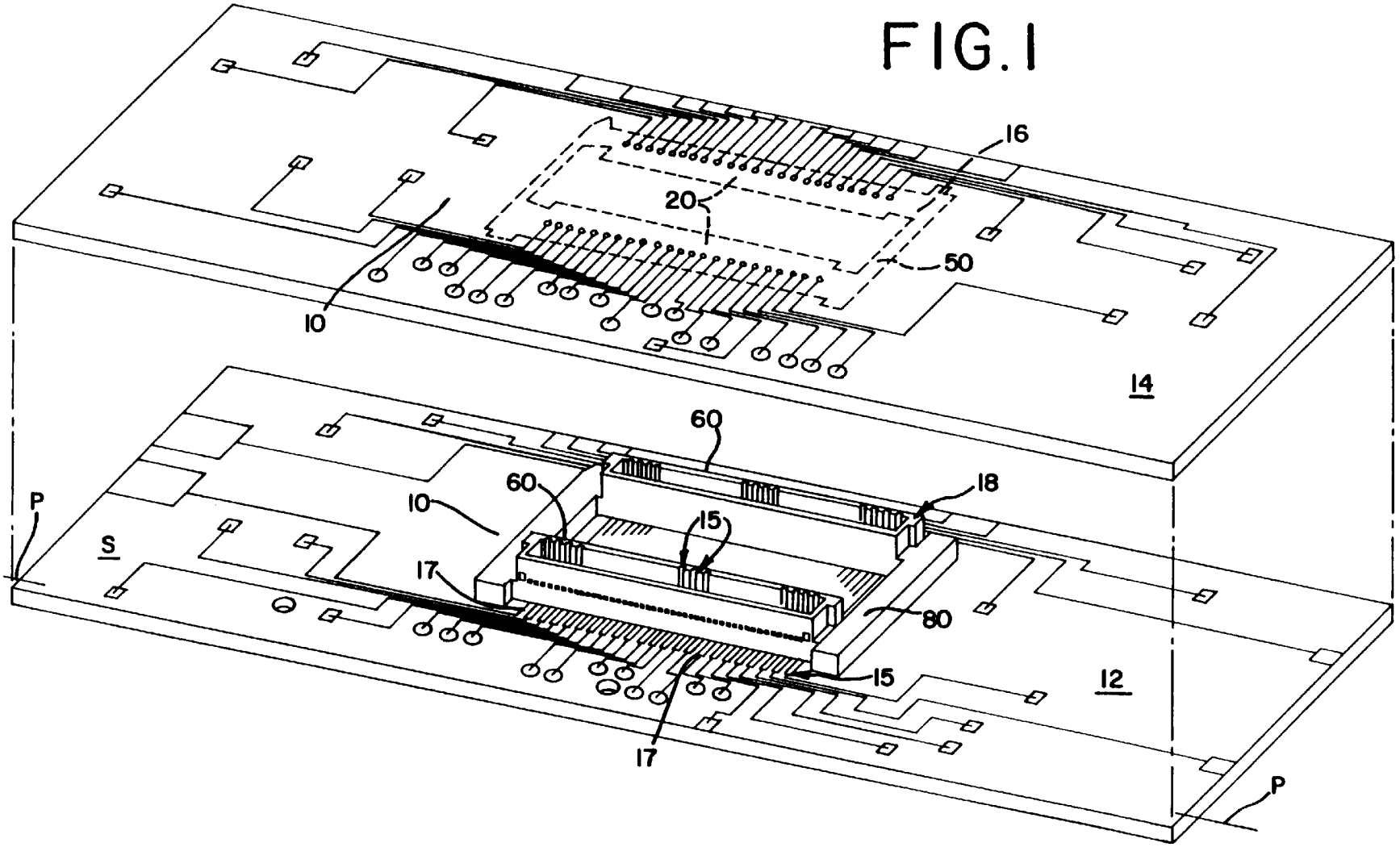
FIG. 1 is an exploded perspective view of a connector assembly constructed in accordance with the principles of the present invention.
Figure 2:
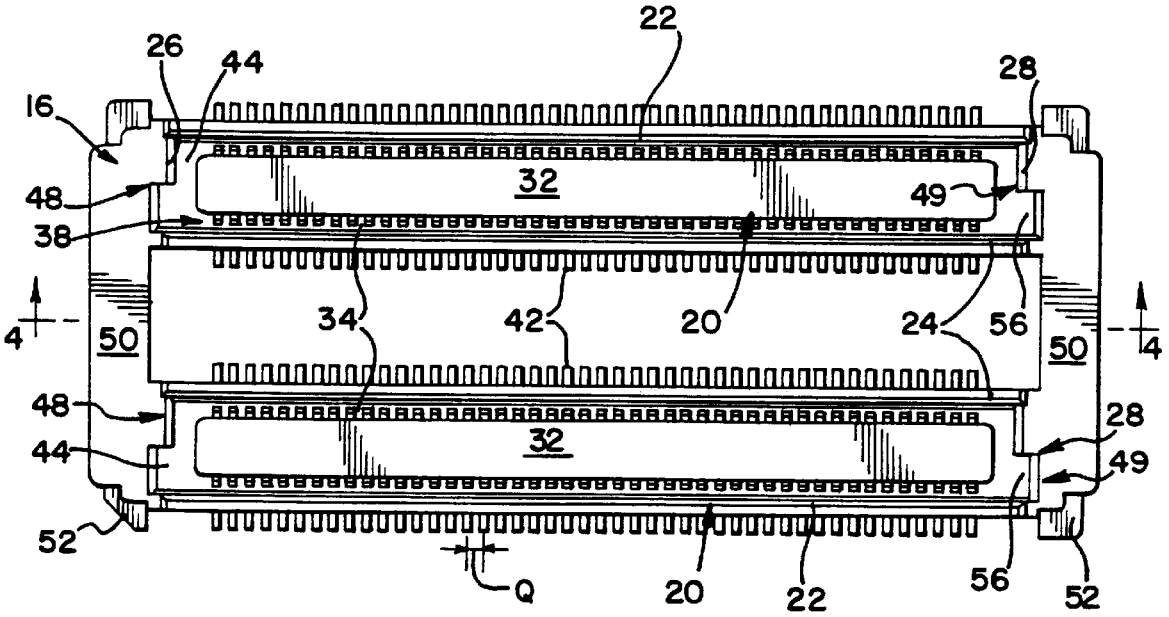
FIG. 2 is a plan view of the female, or receptacle component, of the connector assembly of FIG. 1.
Figure 5:
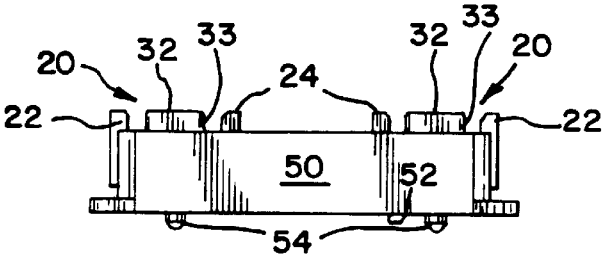
Figure 6:
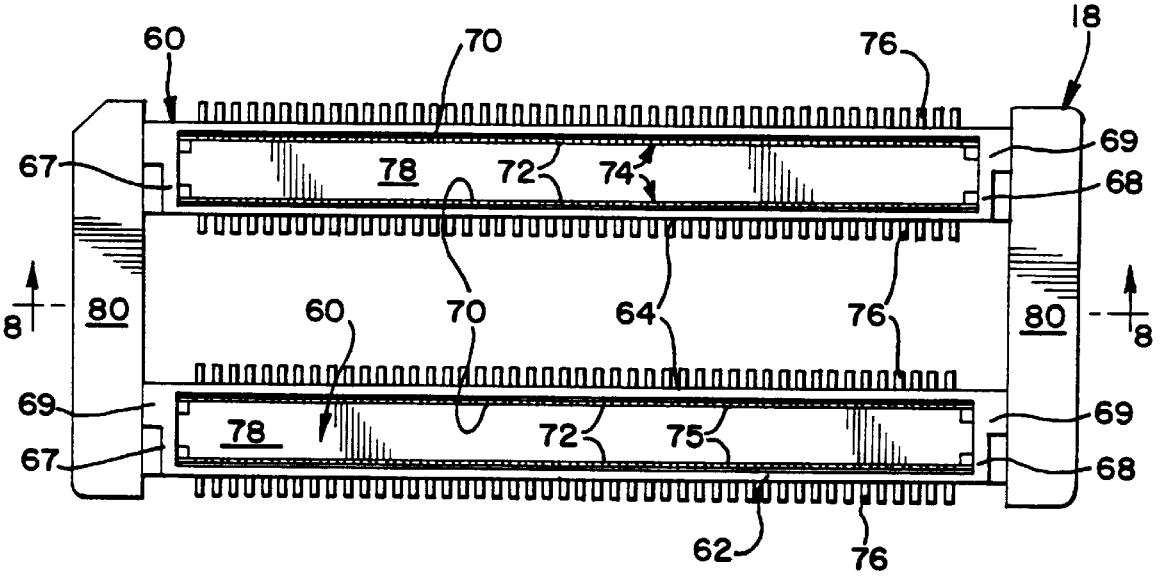
Figure 7:
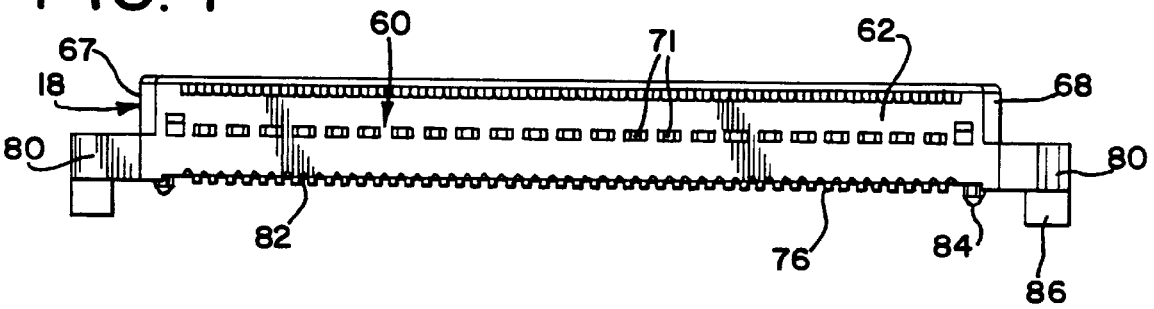
Figure 8:
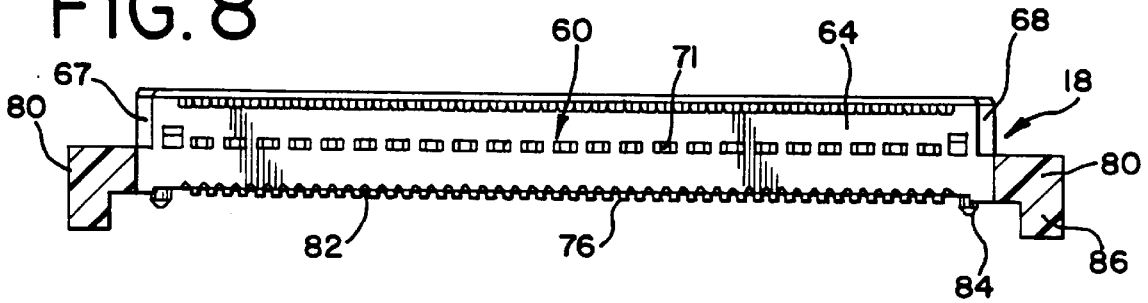
Figure 9:
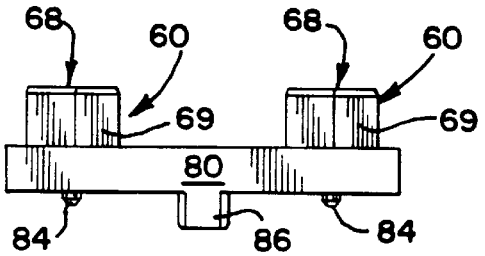
Figure 10:
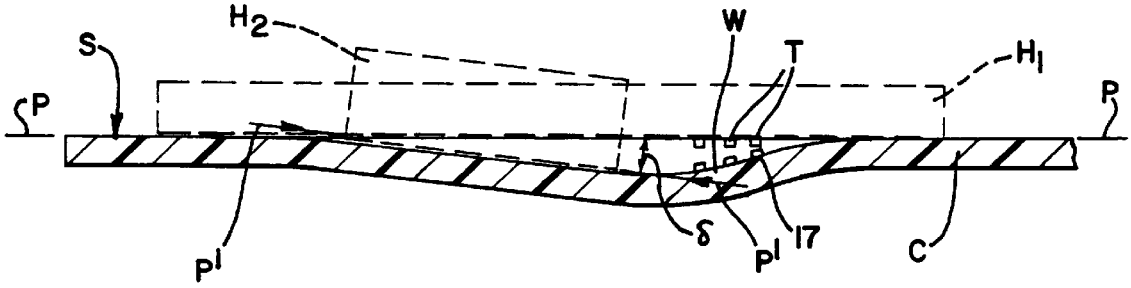
Figure 11:
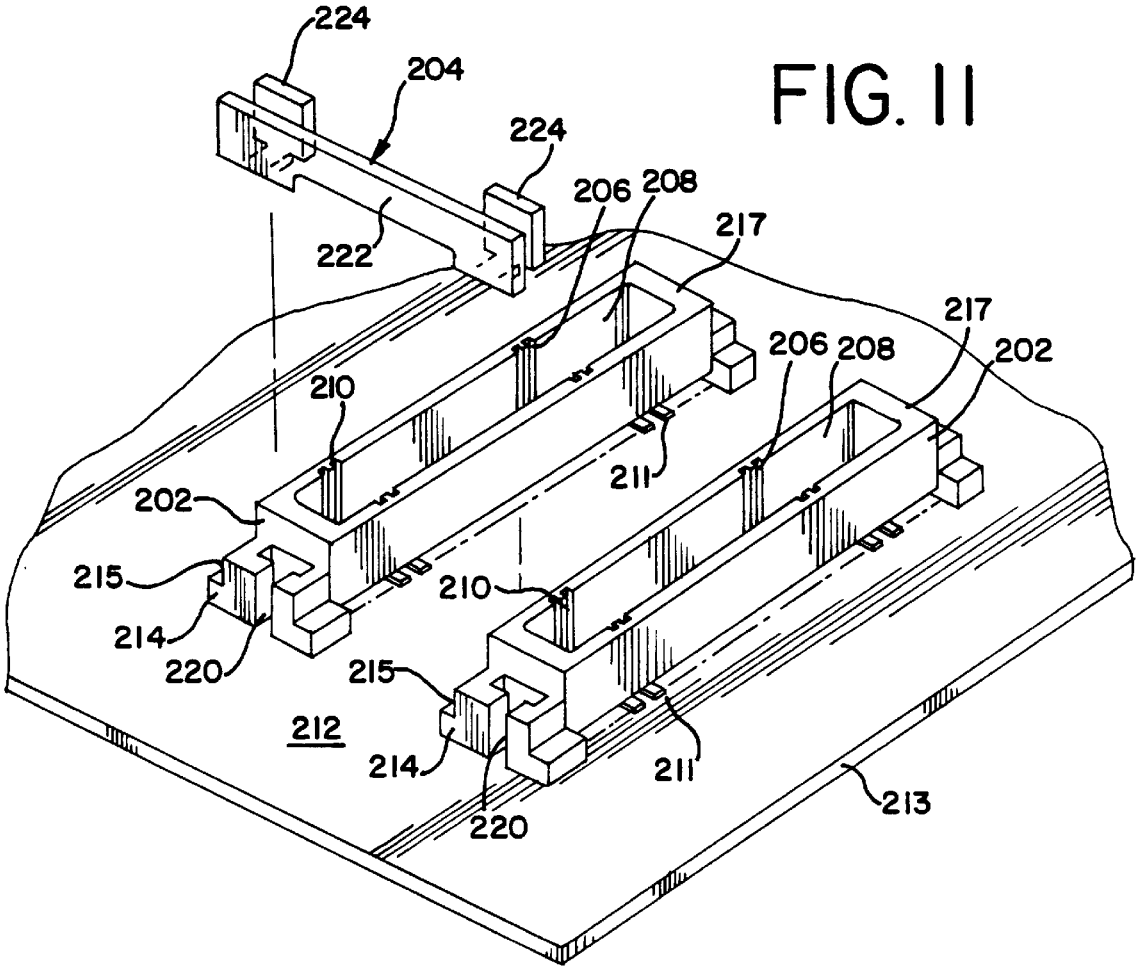
Figure 12:
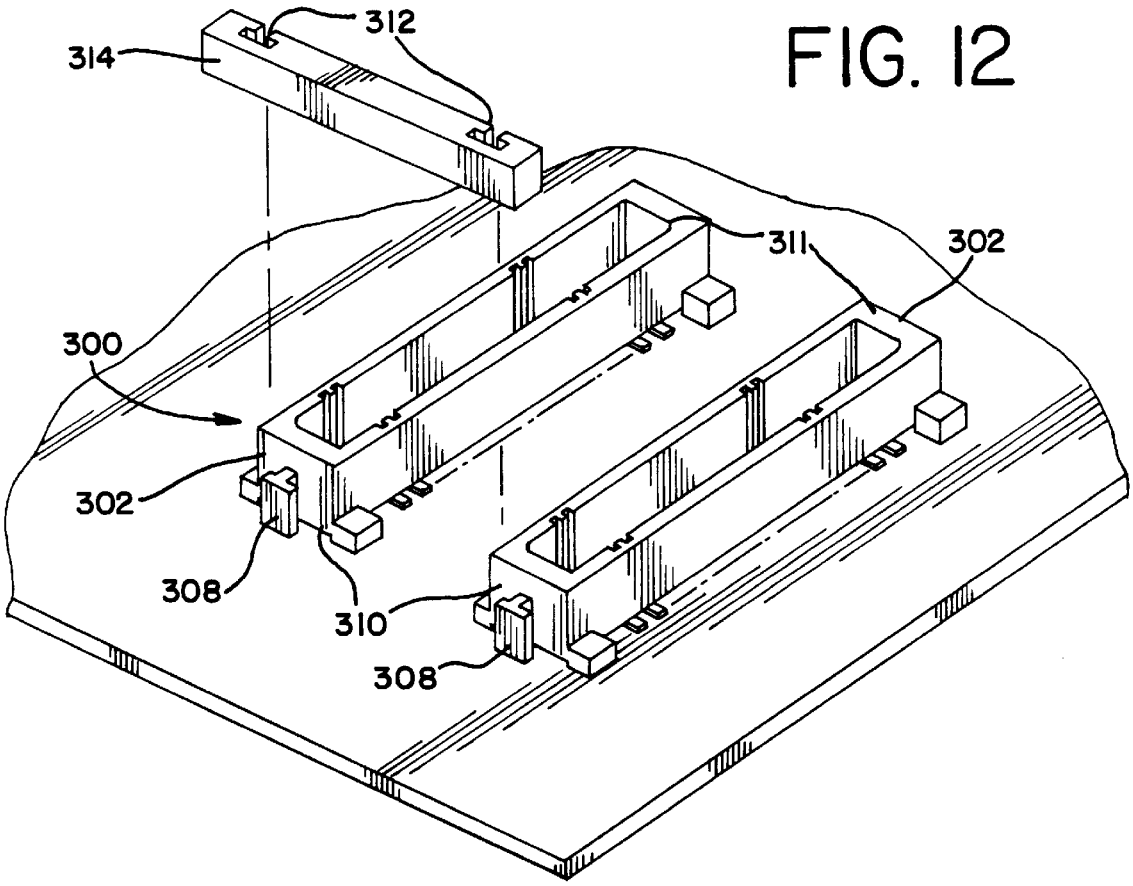
Figure 13:
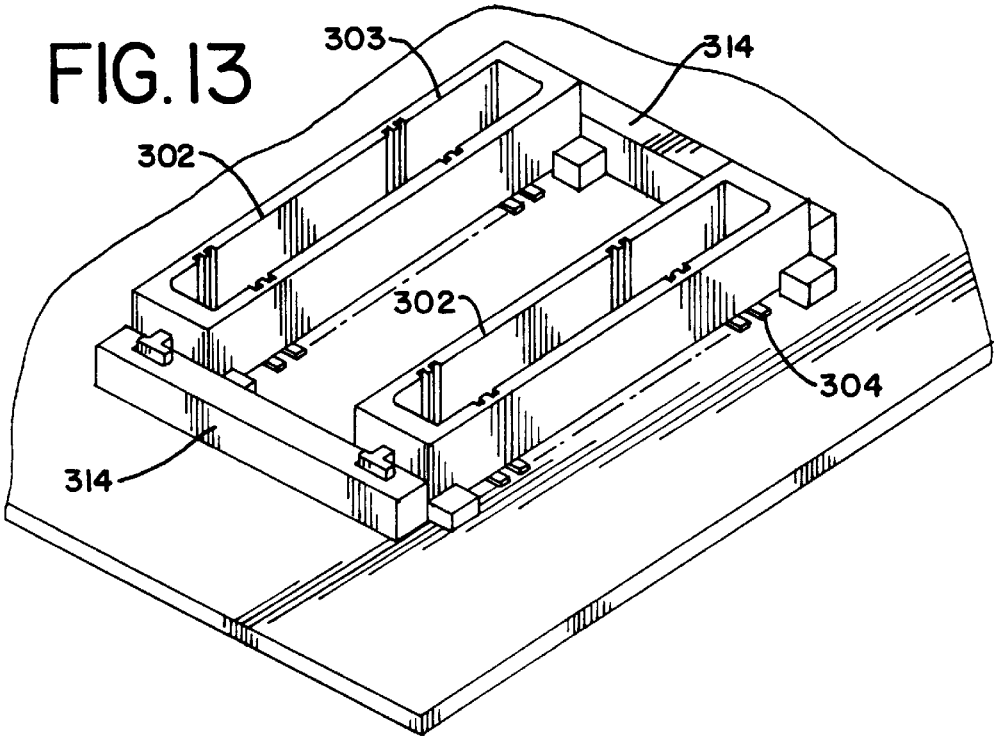
Figure 14:
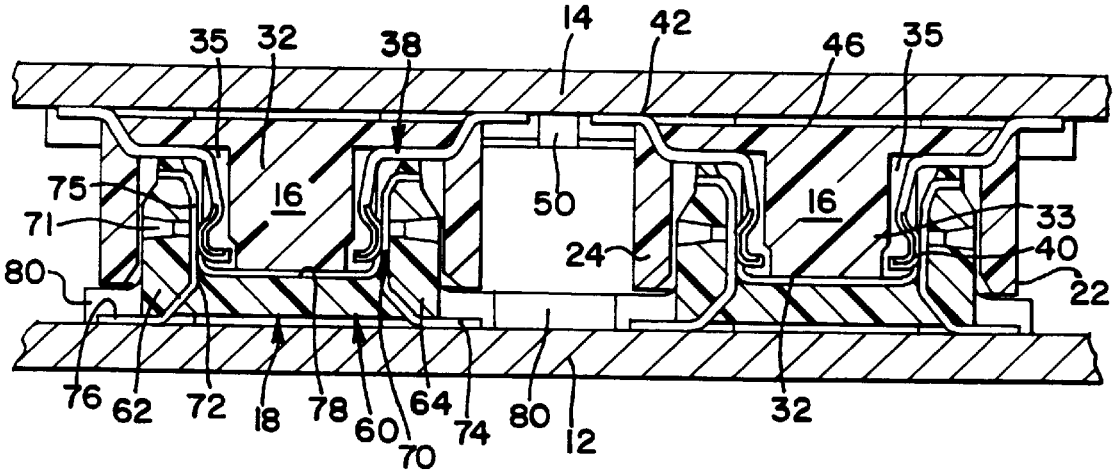
Figure 15:
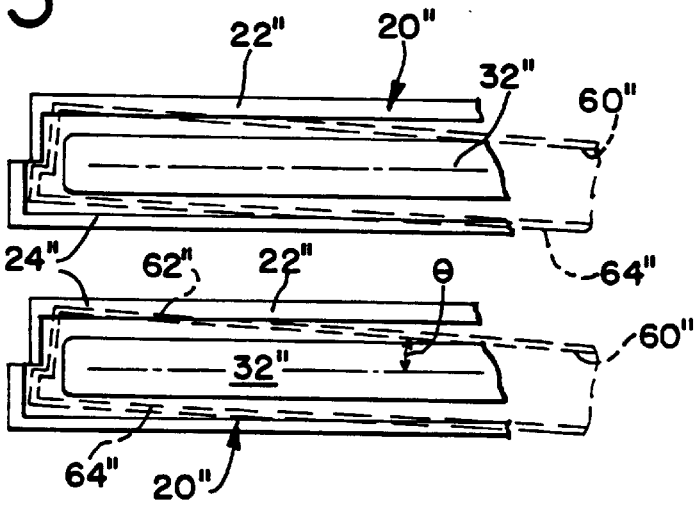
Figure 16:
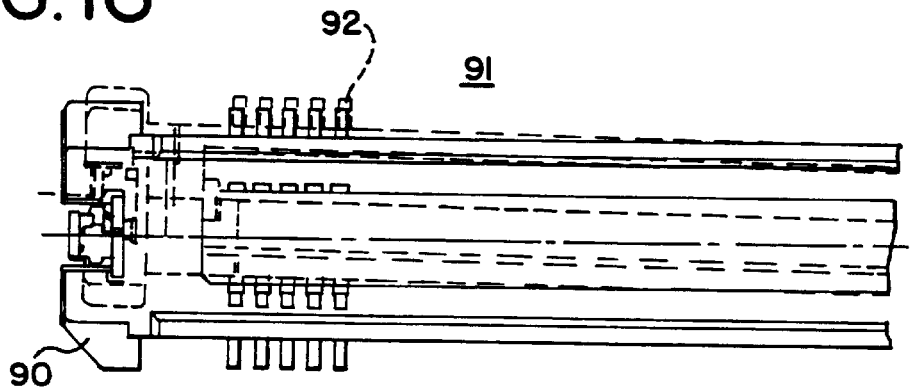

FIG, 4 is a sectional view of the female connector component of FIG. 2 taken along lines 4—4 thereof;

FIG. 5 is an end elevational view of the female connector component of FIG. 2;

FIG. 6 is a plan view of the male, or plug connector component, of the connector assembly of FIG. 1;

FIG. 7 is a side elevational view of the male connector component of FIG. 6;

FIG. 8 is a sectional view of the male connector component of FIG. 6 taken along lines 8—8 thereof;

FIG. 9 is an end elevational view of the male connector component of FIG. 6;

FIG. 10 is a diagrammatic sectional view of a printed circuit board showing the effect of warpage of the circuit board on surface mounting of two different length connectors;

FIG. 11 is an exploded perspective view of a second embodiment of a surface mount board-to-board connector assembly constructed in accordance with the principles of the present invention;

FIG. 12 is an exploded perspective view of a third embodiment of a surface mount board-to-board connector assembly constructed in accordance with the principles of the present invention; and, FIG. 13 is a perspective view of the connector assembly illustrated of FIG. 12 with the connector assembly components interconnected;

FIG. 14 is a sectional view taken through the connector assembly of FIG. 1 in an assembled state;

FIG. 15 is a diagram of two single surface mount board to board connectors illustrating misalignment which may occur between connector housings; and, FIG. 16 is a diagram of a single surface mount connector housing illustrating misalignment which may occur between the connector housing terminal solder tails and the circuit board contact pads.

DETAILED DESCRIPTION OF THE PREFERRED EMBODIMENTS

A surface mount, board-to-board connector assembly constructed in accordance with the principles of the present invention is generally designated at 10 in FIG. 1 and, as illustrated, is shown to interconnect a first circuit board 12 with an opposing, second generally parallel circuit board 14. The connector assembly 10 includes a plurality of electrical terminals, generally indicated at 15, which extend out from two opposing connector component assemblies 16 and 18 and which provide a means for connecting the connector component assemblies 16, 18 to a plurality of corresponding circuit board contact pads, or traces 17, on respective opposing circuit boards 12, 14.

One connector component 16 is illustrated as a female connector assembly while the other connector component assembly 18 is illustrated as a male connector assembly. As explained in greater detail below, portions of the male connector assembly 18 are received within portions of the female connector assembly 16 in order to effect a connection between the two connector assemblies.

Prior to discussing the structure of the connector assembly 10 of the present invention, reference is made to FIG. 10 which illustrates a conventional printed circuit board C having a mounting surface S disposed on one side thereof. The mounting surface S typically defines a mounting plane P—P which ideally is coincident with the mounting surface S of the circuit board C. However, in areas where the circuit board C has warped, or become otherwise distorted, a gap δ occurs between the surface W of the circuit board within the area of warpage and the ideal mounting plane P—P. This gap 6 is generally equal to the displacement distance between the bottom surfaces of the solder tails T of the connector and the actual plane of the circuit board which occurs within the warped area, indicated at P'—P'.

Gap δ presents a problem that may affect the integrity and reliability of the interconnection between the solder tails T and the circuit board contact pads 17. In the assembly of printed circuit boards, and especially when surface mount connectors are involved, a solder paste composed of a powdered solder and a flux is typically applied to the circuit board by way of an appropriate masking process to apply the solder paste onto the areas of the circuit board where connections are to be made, thereby forming a solder paste layer of a predetermined thickness. The solder paste is permitted to partially set-up and connectors and other components are applied to the circuit board to form a circuit board assembly. The surface mount connectors are positioned on the circuit board so that their solder tails lie upon the contact traces and the solder paste layer on the contact traces. The circuit board assembly is then passed through an infrared oven, or other appropriate heating means, in order to melt the solder paste and form a connection between the connector solder tails and the circuit board contact pads.

Acceptable board warpage is often 0.007 inches per inch of board. The solder paste layer is typically very thin, ranging from between approximately 0.006 inches and approximately 0.008 inches. A thin solder paste is required because the pitch, or center to center spacing Q, (FIG. 2) between adjacent terminals tails of surface mount connectors may be very small, on the order of between approximately 0.635 mm to 0.8 mm. A thick solder paste layer may therefore increase the likelihood of the solder paste flowing between contact traces and inadvertently bridging two contact traces when subject to a heating process. Accordingly, if the gap δ is large enough such that a solder tail does not contact the solder paste, it is unlikely that a connection will be made between that particular terminal solder tail and contact pad pair (T, 17), rendering that particular circuit defective and the circuit board potentially useless. Similarly, if the gap 6 is such that the connector solder tail barely touches the solder paste layer but does not touch the contact trace, the connection formed between the particular solder tail-contact trace may be weak. Although these problems may be cured by pressing the solder tails T down into contact with the circuit board contact pads 17, this remedy moves the solder tails out of co-planarity with the remaining terminal solder tails, and further may introduce unnecessary bending stresses into the solder tails which may cause them to break.

As illustrated in FIG. 10, the likelihood of encountering a warped area is increased when a surface mount connector $H_1$ of relatively long length is used as compared to a connector $H_2$ of relatively short length. Depending on the dimensions of the warped area, an appropriately sized connector may be able to abut the surface W of the circuit board within the warped area without encountering any gap between the terminal tails and the circuit board contact pads. However, consonant with the objective of reducing the overall size of the electronic components, circuit boards must accommodate more circuits, so it becomes desirable to interconnect more circuits on the opposing boards together.

As set forth above, the use of a single relatively long connector pair has significant disadvantages due to the difficulty in maintaining contact between the solder tails of the connectors and their respective circuit boards. The present invention provides a board-to-board connector assembly in which each connector component 16, 18 accommodates an increased number of electrical circuits without increasing the overall length of the connector and provides a structure in which the co-planarity of the solder tails is maintained and in which the solder tails of the connector assembly are maintained in alignment with the contact pads 17 of the circuit boards to which it is mounted.

Turning to FIGS. 2–5 and 14, it can be seen that the female connector assembly 16 of the overall connector 10 of the present invention includes a pair of elongated female housing members 20 having opposing sidewalls 22, 24 and endwalls 26, 28 which cooperate to define an interior opening, or receptacle 30. Each receptacle 30 preferably includes an interior pedestal 32 having generally the same height as the sidewalls 22, 24. (FIG. 5.) The pedestal 32, as illustrated, has a generally elongated rectangular, or box-like shape, and is spaced apart from the housing sidewalls 22, 24 and endwalls 26, 28 by a predetermined distance to define an interior channel, or space 36, that surrounds the pedestal 32 of each female housing member 20 and that receive plug portions of counterpart male housing members 60 as explained below.

Figure 3:
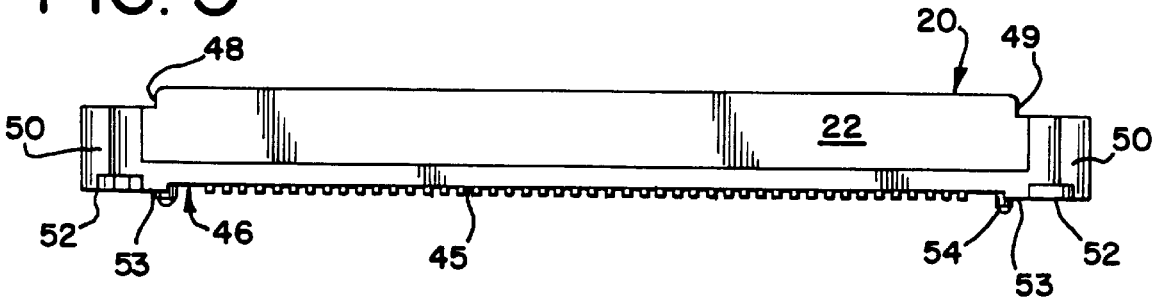
FIG. 3 is a side elevational view of the mail connector component of FIG. 2.
Figure 4:
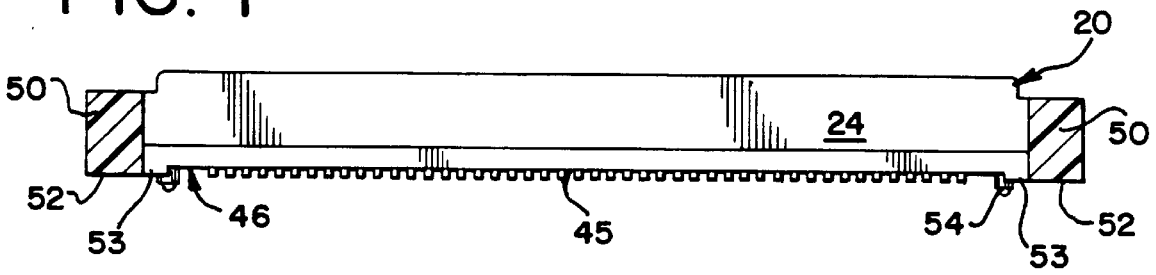

Each female housing member 20 further contains a plurality of electrically conductive terminals 38 disposed therewithin and extending outwardly therefrom. (FIG. 14.) The terminals 38 include contact portions 40 which are disposed along the interior surfaces 33 of the pedestal 32 and tail portions 42 which extend outwardly from the female housing member 20. The terminal tail portions 42 penetrate through bases, or floors 44, of the female housing members 20 and extend outwardly adjacent the bottom surfaces 45 of the female housing members 20 within a recess 46 formed along the bottoms of the housings and extending between the ends 48, 49 of the housings 20. (FIGS. 3 and 4.)

As illustrated in FIG. 2, the dual female housing members 20 are interconnected at their opposite ends 48, 49 by spacer, or bridging members 50, which extend for approximately the full width of the housings 20 between the outermost sidewalls 22 thereof. The spacer members 50 are preferably identical in shape with each other and include base portions 52 which abut base portions 53 of their associated housings 20. (FIG. 3.) The two base portions 52, 53 cooperate to define the recesses 46 at the housings 20 which enclose the terminal tail portions 42. (FIG. 3.) The housing base portions 53 preferably include mounting posts 54 which extend downwardly as shown in FIG. 4 and are received in appropriately sized openings (not shown) formed in the circuit board to accurately position the connectors on the circuit board.

The spacer members 50 maintain the two female housings 20 in a spaced-apart generally parallel relationship and, as illustrated in FIG. 5, the spacer members 50 preferably have a height less than the pedestals 30 and sidewalls 22, 24 of the two housings 20 so that the pedestals and sidewalls may project above the spacer members 50 in order to facilitate engagement with their respective counterpart male housings. The spacer members 50 and housings 20 may be formed from a conventional dielectric material, such as plastic and preferably a high-temperature material such as liquid crystal polymer (LCP), and may be effectively made by a conventional injection molding process, wherein the housings 20 are molded in place around the terminals 38.

As illustrated in the embodiment of FIGS. 1–5, the spacers 50 are integrally formed with the housings 20 so that the resulting female connector assembly 16 constitutes a unitary structure.

In instances where the spacer members 50 are integrally formed with the female housing members 20, the endwalls 26, 28 of the receptacles 30 abut the spacer members 50 and may be offset as illustrated in FIG. 2 to provide a polarizing means, shown as notches 56 which receive like protrusions from counterpart male housing members 60 in order to ensure a proper orientation between the circuits of the two circuit boards 12 and 14.

The male connector assembly 18 is best illustrated in FIGS. 6–9 and 14 wherein it can be seen that the male connector assembly includes two elongated male housing members 60, having a pair of protruding plugs, shown as elongated wall portions 62, 64 interconnected to a pair of endwalls 67, 68 at opposing ends to define an overall rectangular plug associated with each male housing member. The endwalls 67, 68 provide reinforcement to the relatively thin plug walls 62, 64 inasmuch as the mated height between the surface mount connector components 16,18 may range from between approximately 4 mm to 7 mm and the height of the plug walls 62, 64 will consequently range from less than approximately 4 mm to less than 7 mm. The endwalls 67, 68 further define a polarizing means, shown as extensions, or studs 69, which are received within the polarizing notches 56 of the female housing members 20 in order to ensure proper engagement between the two connector assemblies 16, 18.

As shown best in FIG. 14, the protruding wall portions 62, 64 of the male housing members define plugs that are received with the female housing member receptacle channels 34. In this regard, each such protruding wall portion 62, 64 contains a plurality of spaced-apart cavities 70 formed in the inner surfaces 72 of the projecting walls 62, 64 which receive a like number of electrically conductive terminals 74 therein. The male connector housing terminals 74 include contact portions 75 primarily disposed within the cavities 70, and tail portions 76 which project through the bottoms, or floors 78, of the housings 60 to extends outwardly from the male housing members 60. The male housing member terminals 74 are arranged in a longitudinal spacing which substantially matches that of the female housing member terminals 38 so that pairs of opposing male and female housing member terminals 74, 38 will share common centerlines.

In order to facilitate insertion and ensure reliable contact between pairs of opposing terminals, the thickness of the protruding walls or plugs is slightly less than the width of the female housing member channels 34 so that the plug terminal contact portions 75 will reliably engage the female housing member terminal contact portions 40 within the receptacle channels 34. The terminals of both the housing members are preferably formed from a highly conductive material, such as a phosphor bronze alloy and may be gold-plated. The terminals are set in the connector housing members by overmolding, that is positioning the terminals within a mold cavity and injecting molten plastic around them. In this regard, the housing members may include openings 71 in their appropriate sidewalls 62, 64 (FIG. 7) by which the terminals 74 may be held in the mold cavity during manufacture.

The male housing members 60 also include spacer, or bridging members 80, located proximate to the endwalls 67, 68 of the housings 60. The spacer members 80 extend for approximately the width of the male connector assembly 18 (FIG. 6) and, as illustrated in FIGS. 7 and 8, cooperate with the ends of the housings 60 to define an elongated recess 82 which extends along the length of the male housing members 60. These recesses accommodate the tail portions 76 of the male housing member terminals 74.

In an important aspect of the present invention, the spacer members 80 maintain the male housing members 60 in a generally parallel relationship such that the centerlines of the two male housing members 60 will precisely match the centerlines of their two opposing female housing member counterparts 20. In instances where the male housing members 60 and the female housing members 20 do not share the same centerline spacing, or parallelism, the male housing member plug wall portions 62, 64 will be slightly offset from the female housing member receptacle channels 34. This misalignment is likely to cause damage to the plug wall portions 62, 64 themselves, such as by bending them outwardly or by decreasing contact forces between terminals which results in unreliable interconnections. The spacer members 60, 80 substantially decrease the likelihood of such misalignment from occurring between the male and female connector housing assemblies 16 and 18 because they ensure that each of the male housing assemblies will be parallel and each of the female housing assemblies will be parallel. Accordingly, rather than requiring the accurate placement of four connectors, only two connectors must be positioned. This reduces the likelihood of misalignment of the assemblies.

FIG. 15 illustrates one type of misalignment which may occur using surface mount, board-to-board connector housings, in which two, unconnected female surface mount connector housings 20" are mounted to a first circuit board. The connector housings 20" include central pedestal portions 32" enclosed by sidewalls 22" and 24" which define plug-receiving channels 34". If the counterpart male connector housings 60" are also unconnected, they may be misaligned on the opposing circuit board with respect to the female connector housings 20", and the plug portions 62", 64" thereof will be offset with respect to the female channels 34". The interconnection of the connector housings by the present invention reduces the possibility of this type of misalignment from occurring.

The offset may be at an angle θ to a centerline of one of the female connector housings 20" and will result, as shown in phantom, in the plug portions 62", 64" either stressing the sidewalls 22" of the female connector housings 20" by forcing them outwardly, or misaligning or spacing apart opposing pairs of terminals of the two housings.

Each male housing member 60 may further include an appropriate means for mounting the housing members 60 to a circuit board, illustrated as first and second posts 84, 86. (FIGS. 7–9.) Both posts 84, 86 are received within openings formed in the circuit boards. FIG. 16 illustrates an example of another type of misalignment which may occur in surface mount connectors. A connector housing 90 is illustrated as properly positioned on a circuit board 91 within appropriate mounting holes. Superimposed on the connector 90 in phantom is the outline of the same connector, but skewed 1 degree from its centerline which may result from the mounting holes being oversized. This angular displacement has been determined to result in an offset of approximately 0.861 mm. This large offset increase the possibility that the connector terminal solder tails 92 may either be misaligned with respect to their corresponding opposing contact pads 84 of the circuit board or may not effectively contact at least one of the contact pads. As mentioned above, if contact between just one solder tail and contact pad is not made, the circuit is ineffective and so is the connector. The present invention substantially avoids this problem by maintaining the solder tails in alignment.

FIG. 14 is a cross-sectional view of two male and female connector assemblies 16, 18 interengaged in a manner to provide an electrical connection between the first and second circuit boards 10 and 12. As can be seen, the sidewalls 22, 24 and pedestals 32 of the female housing members 20 present channels, or plug connector housing-receiving spaces 34 in which the plug connector housing plug portions 62, 64 of the male housing members 60 are received. The terminals 38, and especially the contact portions 40, of the female housing members 20 are received within recesses 35 formed on the interior surfaces 33 of the pedestals 32 so that they oppose and contact the contact portions 75 of the male housing member terminals 74 held within the cavities 70 of the protruding wall plugs 62, 64.

FIG. 11 illustrates a second embodiment of a surface mount, board-to-board connector 200 constructed in accordance with the principles of the present invention in which a pair of elongated connector housings 202 are interconnected by separate spacer members 204. The connector housings 202 illustrated receive appropriately configured plug portions of male connector housing incorporating similar structure described for the embodiment of FIGS. 1–9, except for the presence of separately formed spacer members 204. The housings 202 include a plurality of terminals 206 disposed on opposing interior surfaces 208 of the housings 202 in a predetermined spacing. The terminals 206 may be disposed within interior cavities 210 as shown, or they may lie adjacent the interior surfaces 208. In any event, the terminals 206 include tail portions 211 which extend outwardly from underneath the housings 202 for connecting to traces, or leads, formed on the surface 212 of a circuit board 213.

The housings 202 include projections 214 at opposing ends 215, 217 which include mounting feet 218 which support the housings 202 on the circuit board 213. These projections 214 include engagement recesses, or notches 220, formed therein and illustrated as T-shaped notches which open outwardly. Separate spacer members 204 interconnect the two housings 202 at their ends. The spacer members 204 include elongated body portions 222 and a pair of engagement members 224 complimentary in shape to the engagement notches 220, and which extend out from the body portions 222. The engagement members 224 are illustrated as T-shaped projections, which are firmly received within the engagement notches 220 in a general press-fit arrangement.

In use, the two housings 202 may be placed onto the circuit board 213 and one spacer 204 may be applied to one end on the two housings by press-fitting the engagement members 224 into their opposing engagement notches 220 of the housings. A second spacer 204 is applied in the same manner to the other end 217 of the housings 202 to thereby align the centerlines of the housings 202 together, as well as to align the centerlines of corresponding pairs of terminals. Similarly, the two housings may be interconnected before placement onto the circuit board.

FIGS. 12 and 13 illustrate a third embodiment of a surface mount, dual housing connector assembly 300 in accordance with the principles of the present invention. As shown, two single connector housings 302, each having a plurality of terminals 303 disposed therein and associated tail portions 304 extending outwardly therefrom. The connector housings 302 include engagement members 308, which are T-shaped as shown, disposed at opposing ends 310, 311 thereof which are received within complimentary-shaped engagement openings 312 of separate spacer members 314 to align the two connector housings in a parallel fashion.

Although the present invention has been described in terms of surface mount, board-to-board dual connector housing assemblies in which one connector half includes two female connector housings and the other connector half includes two male connector housings, it will be understood that the present invention is not to be limited to only those structures. The benefits and advantages described hereinabove will be obtained in surface mount connector assemblies having more than two connector housings as well as in surface mount connector assemblies in which one connector half may include female and male connector housings and the other connector half include counterpart male and female connector housings.

While the particular embodiments of the invention have been described above, it will be apparent to those skilled in the art that changes and modifications may be made therein without departing from the invention in its broader aspects, and, therefore, the aim of the appended claims is to cover all such changes and modifications as fall within the true spirit and scope of the invention.

We claim:

1. A surface mount, board-to-board connector assembly, wherein terminals of the connector assembly lie adjacent the surface of a circuit board when said connector assembly is mounted to the circuit board, said connector assembly comprising: a plug connector half and a receptacle connector half, the plug connector half including two plug connector housings arranged in a spaced-apart, substantially parallel relationship, the plug connector housings being interconnected by first bridging pieces of substantially equal length, the first bridging pieces maintaining said two plug connector housings substantially evenly spaced-apart in said substantially parallel relationship, the receptacle connector half including two receptacle connector housings arranged in a spaced-apart, substantially parallel relationship, the receptacle connector housings being interconnected by second bridging pieces of substantially equal length, the second bridging pieces maintaining said receptacle connector housings substantially evenly spaced-apart in said substantially parallel relationship, each of said two receptacle connector housings having cavities disposed therein, the receptacle connector housing cavities having a plurality of electrical terminals disposed therein, the receptacle connector housing terminals having contact portions disposed within said receptacle connector housing cavities and tail portions extending out of said receptacle connector housings away from said receptacle connector housing cavities, said two plug connector housings having a plurality of electrical terminals associated therewith and further having protruding plug portions, the plug connector housing terminals having contact portions disposed on said protruding plug portions and tail portions extending out of said plug connector housings and away from said protruding plug portions, said plug portions being received within said receptacle connector housing cavities when said plug connector and receptacle connector halves are joined together such that said plug portion terminals and said cavity terminals are maintained in electrical contact with each other.

2. The connector assembly as defined in claim 1, wherein said first and second bridging pieces are integrally formed with said plug connector and receptacle connector housings to define respective unitary plug and receptacle connector halves.

3. The connector assembly as defined in claim 1, further including means for polarizing said plug and receptacle connector halves to ensure said plug portions engage said receptacle cavities in a predetermined orientation.

4. The connector assembly as defined in claim 3, wherein said polarizing means includes slots formed in at least one of said plug and receptacle connector halves and which receive posts extending from the other of said two plug and receptacle connector halves.

5. An improved surface mount, board-to-board connector assembly for providing an electrical connection between electrical circuits disposed on first and second opposing, spaced-apart circuit boards, the connector assembly comprising a plug connector component adapted for mounting to a surface of the first circuit board and a receptacle connector component adapted for mounting to a surface of the second circuit board, the plug component being adapted to be inserted into the receptacle component, the plug connector component including elongated plug connector housings interconnected together by bridging pieces of substantially equal length, whereby the plug connector housing bridging pieces space the plug connector housings substantially evenly apart in a substantially parallel relationship, the receptacle connector component including receptacle connector housings interconnected by bridging pieces of substantially equal length, whereby the receptacle connector housing bridging pieces space the receptacle connector housings substantially evenly apart in a substantially parallel relationship, said receptacle connector housings having engagement cavities and a plurality of electrical terminals associated therewith, the receptacle connector housing terminals including contact portions disposed within said receptacle connector housing engagement cavities and tail portions extending out from said receptacle connector housings away from said receptacle connector housing cavities, the receptacle connector housing terminal tail portions being adapted to engage opposing contact traces on the surface of said second circuit board, said two plug connector housings having a plurality of electrical terminals associated therewith, said plug connector housings further having plug portions protruding therefrom, the plug connector housing terminals having contact portions disposed on the protruding plug portions and further having tail portions extending out of and away from said plug connector housings, said plug connector housing protruding plug portions being aligned with said receptacle connector housing cavities by said plug connector and receptacle connector housing bridging pieces such that when said plug connector and receptacle connector halves are joined together, said plug connector housing protruding plug portions enter said receptacle connector housing cavities without misalignment and said plug connector housing terminals and said receptacle connector terminals are maintained in electrical contact with each other.

6. The connector as defined in claim 5, wherein said plug connector housing bridging pieces and said receptacle connector housing bridging pieces are respectively integrally formed with said plug connector housings and said receptacle connector housings.

7. The connector as defined in claim 5, wherein said plug and receptacle connector housing bridging pieces respectively interconnect said plug and receptacle connector housings together at opposing ends of said plug and receptacle connector housings.

8. A surface mount, board-to-board connector for electrically connecting circuits on two opposing, spaced-apart circuit boards, comprising a male connector assembly and a female connector assembly adapted for engagement with each other, the male connector assembly including two male housings having a plurality of electrically conductive terminals, the female connector assembly including two female housings having a plurality of electrically conductive terminals, the male and female housing terminals being disposed along respective engagement surfaces of said male and female housings which face each other when said male and female connector assemblies are engaged with each other, the male housings being spaced apart from each other and maintained in a first spacing by male housing assembly spacer members wherein centerlines of said male housings are substantially parallel and which interconnect said male housings together, the female housings being spaced apart from each other and maintained in a second spacing by female housing assembly spacer members wherein centerlines of said female housings are substantially parallel and which interconnect said female housing together, the male and female housing assembly spacer members further serving to align said male and female housing respective engagement surfaces, thereby reducing the likelihood of misalignment of said respective engagement surfaces.

9. The connector as defined in claim 8, wherein said male and female housing assembly spacer members are integrally formed with said male and female housings.

10. The connector as defined in claim 8, wherein said male and female housing assembly members respectively interconnect said male and female housings together at opposing ends thereof.

11. The connector as defined in claim 8, wherein said terminals include contact portions which extend along said male and female housing respective engagement surfaces and further include tail portions which extend generally perpendicularly away from said male and female housing centerlines, said male and female housing assembly spacer members maintaining opposing pairs of male and female housing terminals in alignment.

12. The connector as defined in claim 8, wherein said male and female housing assembly spacer members and said male and female housings are integrally formed together as respective unitary male and female connector assemblies.

13. A surface mount, board-to-board connector assembly, comprising: a first connector half and a second connector half, the first connector half including two first connector housings arranged in a spaced-apart, substantially parallel relationship, the first connector housings being interconnected by first bridging pieces of substantially equal length, the first bridging pieces maintaining said two first connector housings substantially evenly spaced-apart in said substantially parallel relationship, the second connector half including two second connector housings arranged in a spaced-apart, substantially parallel relationship, the second connector housings being interconnected by second bridging pieces of substantially equal length, the second bridging pieces maintaining said second connector housings substantially evenly spaced-apart in said substantially parallel relationship, each of said two second connector housings having second surfaces disposed therein, the second connector housing surfaces having a plurality of electrical terminals disposed thereon, the second connector housing terminals having contact portions disposed on said second connector housing surfaces and tail portions extending out of said second connector housings away from said second connector housing surfaces, said two first connector housings having a plurality of electrical terminals associated therewith first, the first connector housing terminals having contact portions disposed on first surfaces of said first connector housings first and tail portions extending out of said first connector housings and away from said first surfaces, said first surfaces engaging said second connector housing second surfaces when said first connector and second connector halves are joined together such that said first connector housing terminals and said second connector housing terminals are maintained in electrical contact with each other.

14. The connector assembly as defined in claim 13, wherein said two first connector housings include two male connector housings and said two second connector housings include two female connector housings.

15. A surface mount, board-to-board connector for electrically connecting circuits on two opposing, spaced-apart circuit boards, comprising a first connector assembly and a second connector assembly adapted for engagement with each other, the first connector assembly including two first connector housings having a plurality of electrically conductive terminals, the second connector assembly including two second connector housings having a plurality of electrically conductive terminals, the first and second connector housing terminals being disposed along respective engagement surfaces of said first and second connector housings which face each other when said first and second connector assemblies are engaged with each other, the first connector housings being spaced apart from each other and maintained in a first spacing by first connector housing assembly spacer members wherein centerlines of said first housings are substantially parallel and which interconnect said first connector housings together, the second connector housings being spaced apart from each other and maintained in a second spacing by second connector housing assembly spacer members wherein centerlines of said second connector housings are substantially parallel and which interconnect said second connector housings together, the first and second connector housing assembly spacer members further serving to align said first and second housing respective engagement surfaces and maintain opposing pairs of said first and second connector housing terminals in alignment, thereby reducing the likelihood of misalignment of said respective first and second connector housing engagement surfaces and misconnection between said opposing pairs of said first and second connector housing terminals.

16. The connector as defined in claim 15, wherein said first and second connector housing assembly spacer members are joined together with said first and second connector housings.

17. The connector as defined in claim 16, wherein said first and second connector housing assembly spacer members are joined together with said first and second connector housings by molding said first and second connector housing assembly spacer members to said first and second connector housings.

18. The connector as defined in claim 17, wherein said first and second connector housing assembly spacer members are joined together with said first and second connector housings by overmolding said first and second connector housing assembly spacer members with said first and second connector housings around said first and second connector housing terminals.

19. The connector as defined in claim 16, wherein said first and second connector housing assembly members respectively interconnect said first and second connector housings together at opposing ends thereof, and said first and second connector housing assembly members include base portions that abut base portions of said first and second connector housings.

20. The connector as defined in claim 15, wherein said first and second connector housing assembly members include base portions that abut base portions of said first and second connector housings, said first and second connector housing terminals including contact portions which extend along respective engagement surfaces of said first and second connector housing and further include tail portions which extend generally perpendicularly away from said first and second connector housing centerlines at a level generally above said first and second connector housing assembly member base portions.

21. The connector as defined in claim 15, wherein said first connector housings are male connector housings and said second connector housings are female connector housings.

22. The connector as defined in claim 15, wherein said first connector housings are plug connector housings and said second connector housings are receptacle connector housings.

23. The connector as defined in claim 15, wherein said first connector housings include at least one male connector housing and said second connector housings include at least one female connector housing engageable with said one male connector housing.

24. The connector as defined in claim 20, wherein said first and second connector housings include base recesses disposed along bottom surfaces thereof and said first and second connector housing terminal tail portions are received within the base recesses and extend outwardly from said first and second connector housings through said base recesses.

25. The connector as defined in claim 16, wherein said first and second connector housing assembly members respectively interconnect said first and second connector housings together at opposing ends thereof, and further including means for polarizing said first and second connector housings to ensure said first connector housings engage said second connector housings in a predetermined orientation.

* * * * *